United States Patent [19]

Metz

[11] Patent Number: 4,690,400

[45] Date of Patent: Sep. 1, 1987

[54] SUPINATING BARBELLS WITH MEANS TO SET THE FORCE FOR ROTATORY MOTION

[76] Inventor: Charles L. Metz, R.D. #9 - Box 683A, Greensburg, Pa. 15601

[21] Appl. No.: 806,600

[22] Filed: Dec. 9, 1985

[51] Int. Cl.[4] ..... A63B 13/00

[52] U.S. Cl. ..... 272/123; 272/67; 272/143; 272/132

[58] Field of Search ..... 272/67-68, 272/93, 122-124, 131-132, 143, DIG. 4

[56] References Cited

U.S. PATENT DOCUMENTS

| | | | |
|---|---|---|---|
| 1,536,048 | 5/1925 | Alastalo | 272/122 |
| 2,819,081 | 1/1958 | Touraine | 272/67 |
| 3,384,370 | 3/1965 | Bailey et al. | 272/123 |
| 4,440,391 | 4/1984 | Saenz, Jr. et al. | 272/93 |
| 4,461,473 | 7/1984 | Cole | 272/123 |
| 4,585,229 | 4/1986 | Brasher | 272/123 |
| 4,618,143 | 10/1986 | Twardosz | 272/143 X |

FOREIGN PATENT DOCUMENTS

| | | | |
|---|---|---|---|
| 223926 | 6/1985 | German Democratic Rep. | 272/123 |

*Primary Examiner*—Richard J. Apley
*Assistant Examiner*—Robert W. Bahr
*Attorney, Agent, or Firm*—Clifford A. Poff

[57] ABSTRACT

Barbells are provided having a pair of circular housings within which handles are mounted for rotational movement, and screw threads are provided that are operatively associated with the handles for varying, as desired, the degree of resistance to rotatory movement of the handles from the near-zero to locking. The housings are in members which contain connection members such that they may be joined directly to each other or may be spaced apart at desired distances, to suit the physique of the user and/or the nature of the exercise to be performed. Such barbells not only affords exercise which advantageously stresses the biceps muscles in their supinating function but also makes it possible, with one unitary set of equipment, to perform exercises which would otherwise require the employment of a few different types of special-purpose barbell equipment.

13 Claims, 7 Drawing Figures

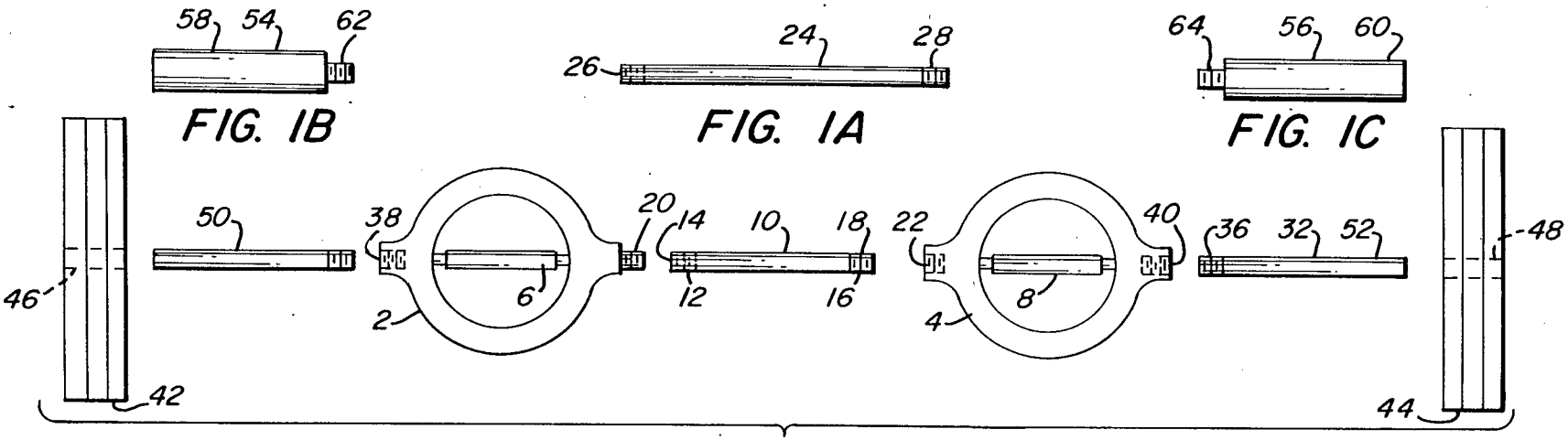
FIG. 1
FIG. 1A
FIG. 1B
FIG. 1C
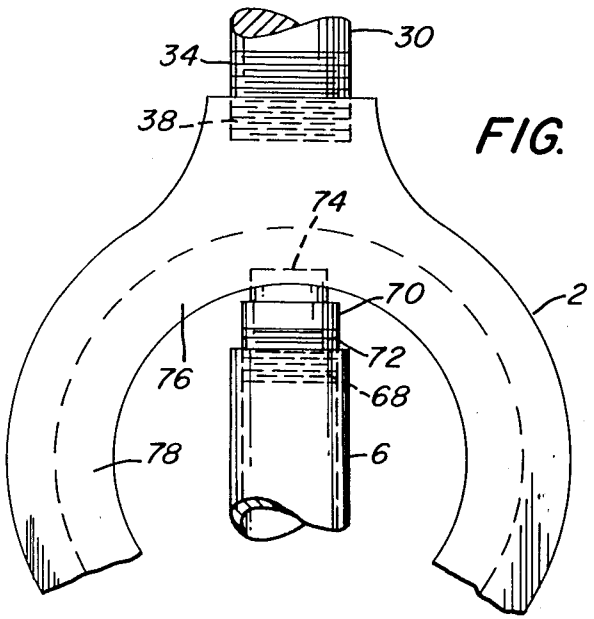
FIG. 2
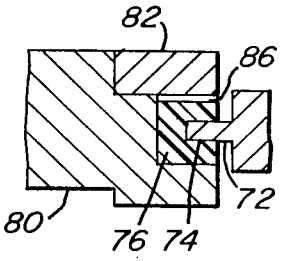
FIG. 4
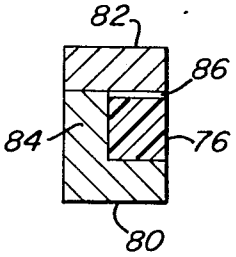
FIG. 3

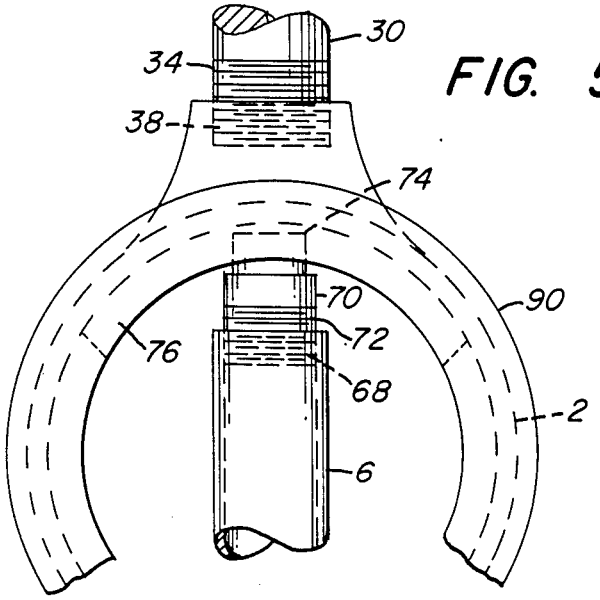
FIG. 5
FIG. 6
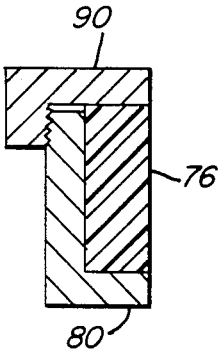
FIG. 7
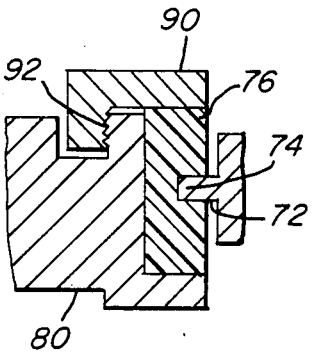

SUPINATING BARBELLS WITH MEANS TO SET THE FORCE FOR ROTATORY MOTION

BACKGROUND OF THE INVENTION

1. Field of the Invention

This invention relates to apparatus for use in exercise of the human body, and in particular, it relates to an improvement in exercise equipment which is in the nature of a barbell.

2. Description of the Prior Art

It is known, for example, from Bailey et al U.S. Pat. No. 3,384,370, to provide an exercise device or weightlifting apparatus which is in the nature of a set of barbells, but has, along the length of the bar which bears the weights near its ends a pair of generally circular housings that contain handle members. From the Bailey et al patent, it can be taken as already known that it is possible to have barbells which may be used in such a manner that, for example, in raising the barbells from the floor to chest level, the hands of the user may be rotated from an initial position (with their palms facing each other) to a second position (with the palms facing the user's chest). It is known to those skilled in the art of body building that this particular motion of rotating the hands is called "supination", and the reverse motion, from palms facing chest to palms facing each other, is called "pronation".

It has been known, before the present invention, that the biceps muscles, located in the upper arm between the elbow and the shoulder, are involved in the action of supination, in addition to performing the task for which they are best known, namely, flexing the arm to bring the hands inwardly toward the body.

Ordinary barbells, ones consisting of an elongated rod and weights thereon near to its ends, though useful for many exercises, do not serve the purpose of providing exercise to the particular muscles which are involved in the process of supinating. With ordinary barbells, ones without the circular housings and handles shown in the above-mentioned Bailey et al patent, there is an absolute minimum of development of the muscles involved in the supinating action. It would not be accurate to say that such use of known barbells of the kind having a simple straight barbell provide no development whatever of the portions of the biceps muscles involved in the action of supinating, because it is impossible to increase appreciably the overall strength of the biceps muscles without obtaining at least some effect of this sort. At the same time, however, the degree of development in the supinating function of the biceps muscles can be achieved using a straight-bar barbell is, relatively speaking, minimal. Those skilled in the art of body building have recognized that to obtain a more nearly optimal development of the biceps muscles, it is necessary to perform some exercises which at least involve some supinating and pronating action, such as the use of either individual dumbbells held in the two hands or the use of a barbell with handles located in circular housings along a barbell, as in the above-mentioned U.S. Pat. No. 3,384,370.

What has been missing from the prior art is an exercise device which includes a means for adjusting, as desired, the degree of resistance to the supinating and pronating actions. In the prior art as exemplified by U.S. Pat. No. 3,384,370, there are provided handles which are capable of being turned, so that supination can be performed while curling the barbell, but in the device of that patent, there are used roller bearings to provide "greater ease of movement, more flexibility and less strain on the wrists and elbow joints of the user."

Moreover, in the prior art, there are known a number of different kinds of barbell which possess, for various different purposes, gripping portions which are variously located farther apart or closer together and/or variously angularly oriented with respect to the main central longitudinal axis of the barbell. The prior art has not suggested how it would be possible, by providing one apparatus equipped with appropriate spacers and connection means and with tension-adjustment means capable of locking the handles in any desired position, to achieve with one apparatus what had previously required the use of a few different kinds of special-purpose barbell.

BRIEF SUMMARY OF THE INVENTION

Barbells are provided having a pair of circular housings within which handles are mounted for rotational movement, and means are provided that are operatively associated with the handles for varying, as desired, the degree of resistance to rotatory movement of the handles from the near-zero to locking. The housings are in members which contain connection means such that they may be joined directly to each other or may be spaced apart at desired distances, to suit the physique of the user and/or the nature of the exercise to be performed. Such apparatus not only affords exercise which advantageously stresses the biceps muscles in their supinating function but also makes it possible, with one unitary set of equipment, to perform exercises which would otherwise require the employment of a few different types of special-purpose barbell equipment.

DESCRIPTION OF THE DRAWINGS

A complete understanding of the invention may be obtained from the foregoing and following description thereof, taken in conjunction with the appended drawings, in which:

FIG. 1 is an exploded plan view of barbell equipment in accordance with the present invention;

FIG. 2 is a detail plan view of one part of the equipment shown in FIG. 1, indicating one mode for providing for the adjustment of the resistance to rotatory motion;

FIG. 3 is a sectional view taken on the line III—III of FIG. 2;

FIG. 4 is a sectional view taken on the line IV—IV of FIG. 2;

FIG. 5 is a plan view, similar to FIG. 2, for indicating an alternative mode of providing adjustment of the resistance to rotary motion;

FIG. 6 is a sectional view taken on the line VI—VI of FIG. 5; and

FIG. 7 is a sectional view taken on the line VII—VII of FIG. 5.

DESCRIPTION OF THE PREFERRED EMBODIMENTS

In FIG. 1, there is shown an exploded view in plan of equipment in accordance with the present invention. FIG. 1 shows a pair 2, 4 of circular housing members which serve for the mounting for rotatory movement of handles 6, 8. As will be explained in greater detail hereinbelow, the handle members 6 and 8 have associated therewith means for varying, as desired, the degree of FIG. 1A illustrates an alternate spacer member of the present invention having a length greater than the spacer member of the present invention having a length greater than the spacer member illustrated in FIG. 1.

FIGS. 1B–1C illustrate alternate bar members used when Olympic sized weights are utilized with the present invention.

resistance to rotatory movement which is possible while a barbell set according to the present invention is being used.

As further shown in FIG. 1, there is preferably provided a spacer member 10, preferably having a first end 12 having therein a female threaded connection member 14 and an end 16, preferably having therein a male threaded connection member 18. The female connection member 14 is adapted to mate with a male connection member 20 at one end of the circular housing member 2, and the circular housing member 4 has at one end thereof a female connection member 22, which is adapted to mate with the male connection member 18 at the end 16 of the spacer member 10.

Moreover, the dimensions of the male connection member 20 of the circular housing member 2 and the female connection member 22 of the circular housing member 4 are such that the two may be joined directly with each other; there are purposes involving the exercise of the triceps muscles for which it would be desirable to provide barbell equipment which is grasped by the user with his hands being located relatively close together.

Shown in FIG. 1A is an alternative spacer member 24 having a first end containing a female connection member 26 which is adapted to mate with the projection 20 of the circular housing member 2 and a male connection member 28 which is adapted to mate with the female connection member 22 of the circular housing member 4. As shown in FIG. 1, the spacer member 24 is longer than the spacer member 10. Ordinarily, it is desirable for the spacer member 10 to have such a length that the handles 6 and 8 are approximately 14 inches apart, i.e., the distance between the hands of the user if the user is a person of relatively average size or, what is more pertinent, shoulder breadth. The alternative spacer member 24 is shown as being somewhat longer than the spacer member 10, and such a member would be useful if the user of the equipment were, for example, a person of greater shoulder breadth, i.e., someone whose hands might stand, while in a position ready to pick up this barbell apparatus, approximately 18 to 23 inches apart.

Those skilled in the art will understand that still other spacers, of greater or lesser breadth, may be provided, if desired.

Referring again to FIG. 1 the apparatus further comprises members 30, 32, which are in the nature of elongated bars having threaded ends 34, 36, respectively, for engaging with female connection members 38, 40, respectively, of the circular housing members 2, 4.

Also shown in FIG. 1 are sets of weight members 42, 44, having therein central bore members 46, 48 of such dimensions as to receive relatively snugly the ends 50, 52 of the bar members 30, 32, respectively.

Means (not shown) may be provided, if desired, to secure the weights to the portions 50, 52 of the bar members 30, 32, as will be well understood by those skilled in the art. In a lot of cases, weights such as the weights 42, 44 are used without providing any particular means to secure them to the bar on which they are mounted, in order to make for the relatively ready addition and subtraction of additional weights.

As those familiar with the use of weightlifting barbells are well aware, there are the usual barbells, in which the bore openings such as those shown in the drawings at 46 and 48 are approximately 1 inch in diameter, and there are the Olympic barbells, where the weights which are provided have a central opening approximately 2 inches in diameter.

Accordingly, there are also shown in FIGS. 1B and 1C the members 54 and 56, and these have, respectively, the ends 58 and 60, which are approximately 2 inches in diameter, so as to serve for the receiving of weights having a central bore opening on the order of 2 inches while having at their opposite ends, 62 and 64, respectively, male threaded connections which may be connected to the female openings 38 and 40, respectively, mentioned above.

Moreover, particularly in accordance with the present invention, means which are more particularly discussed hereinbelow are provided in order that there may be varied, as desired, from a value of close to zero to a value sufficiently high that the handles 6 and 8 are, effectively, locked in a particular position, means such that the resistance to rotatory motion, the resistance to turning from one position to another of the handles 6 and 8 within the circular housing members 2 and 4, may be varied or regulated. In FIG. 2, there is depicted an end, in plan view, of a circular housing member 2 or 4, and there is shown, in particular, how a handle member 6 or 8 may, in accordance with one manner of practicing the invention, be so mounted within the circular housing 2 or 4 as to possess the capability of being adjusted in respect to the amount of force which may be required in order to cause the handle 6, for example, to be rotated in respect to the circular housing member 2, for example, or the like. Referring now particularly to FIG. 2 and to FIGS. 3 and 4, which are partial cross-sectional views taken with respect to FIG. 2, there are shown therein the means by which a handle 6 may be mounted within a circular housing 2 for rotatory movement with respect to the housing, with there being provided a controllable degree of resistance to the rotatory motion. As may be seen from FIG. 2, the handle 6 possesses an interior bore 68 which is interiorly threaded, and there is a member 70 having at one end thereof male threads 72 which mate with the female threads in the bore 68. The member 70 has, moreover, a tongue 72 which fits into a suitable slot 74 in a shoe member 76, which is adapted to move in a pathway 78 which is provided in the circular housing member 2 or 4.

A shoe member 76 may advantageously be made of any suitable material, such as a known polyacetal resin sold under the trademark or trade name of "Delrin", or of polytetrafluoroethylene, or of any other suitable material. As can be seen from FIG. 3, the shoe 76 may, in one embodiment of the invention, be adapted to be moved within a raceway 78 which is formed between a lower portion 80 of the circular housing member 2 or 4 and a cap portion 82. The cap portion 82 may take the form of a ring which is adapted to be secured to a portion 84 of the member 80 by bolts or screws or other suitable means (not shown). There is shown in FIGS. 3 and 4, a gap 86 between the top of the shoe 76 and the cap member 82, and the structure is so shown in order to make it clear that, in this embodiment of the invention, there is no intention that the cap ring 82 will contribute in any way to the retarding of the motion of the shoe 76 with respect to the pathway 78 within which it is movable.

It is to be understood that the handle member 6 has, at the end opposite from that which is shown in FIG. 2, in at least one embodiment of the invention, a screw-threaded interior portion corresponding to the portion 68 but of the opposite hand, and a similar structure outboard of that, connecting the opposite end of the handle 6 or 8 to another similar shoe, like the shoe 76, for motion in the pathway 78.

Those skilled in the art will appreciate, moreover, that similar results can be obtained even without providing an opposite-handed screw member fitting into the other end of the handle 6, relying instead upon the screw threads in the portions indicated above at 68 and 72 for the totality of the forcegenerating action which can be obtained by rotating the handle 6 or the like.

Experience with a model of the invention has demonstrated that it is possible to obtain, at least for a limited period of time, the effect that the degree of tension which is obtained by turning the handle 6 or 8 to a particular position does not vary appreciably, even if one does not provide a locking nut and its cooperating washer (not shown in the drawings) in order to secure the handle member against becoming rotated about its longitudinal axis and thereby varying the value of the resistance of the handle to rotatory motion within its related circular housing. In a preferred manner of practicing the invention, such locking nuts and washers are, of course, preferably provided and used, in a manner which will be obvious to persons skilled in the art of the design of machinery.

The shoes of "Delrin" polyacetal resin or other suitable material preferably extend, each of them, for about one quarter of the entire circular extent of the pathway 78. If desired, there could be used a ring of such material extending throughout the circular extent of the pathway 78, but such practice would be needlessly expensive because of the added material used and possibly disadvantageous because of the tendency of the ring to crack.

The selection of the polyacetal resin material has been found to make it possible to obtain, without the use of any added lubricant material, an adequately smooth motion of the handles when the equipment of the invention is used. Those skilled in the body building will appreciate the desirability of avoiding the use of such lubricant materials.

It has been found that a satisfactory working model can be made when the threads 68 and 72 are spaced apart at about 14 to 16 threads per inch, but this value can obviously be varied somewhat, in order to obtain a finer or coarser adjustment, if desired.

In a preferred manner of practicing the invention, there are provided on the member 70 and the end of the handle 6 adjacent thereto some indicia which will cooperate to permit the adjustment of the degree of resistance to rotatory motion of the handle 6 within its housing to some relatively reproducible valve, known or not. Of course, similar indicia are preferably also provided with respect to the handle 8.

Still another conceivable means for adjusting the degree of resistance to rotatory motion of the handles 6, 8 is indicated in the cross-sectional view of FIG. 5, in which there is depicted an arrangement such that the shoes 76 are retarded by means of a cap member 90 which is secured to the base member 80 by threads as indicated at 92.

Various exercises can be performed with the above equipment. With the circular housings mounted to form a barbell, there may be performed any of: (1) standing curls, (2) preacher curls, (3) overhead press, (4) triceps extension standing, (5) triceps extension seated, (6) triceps extension on back, and (7) pullover on back. By using the rings and handles separately, there can be performed still other exercises, namely: (8) cable curls, (9) cable curls seated, (10) French curls standing, (11) French curls seated, (12) close grip triceps bench on back, (13) lat machine pulldowns, (14) lat machine chest pulldowns, and (15) cable triceps pushdowns. Moreover, all of the foregoing may be done while supinating and pronating.

Those skilled in the art of body building will surely appreciate that the above-described device of the invention, in comparison with any barbell device of the prior art known to the inventor affords a distinct advantage; the load and resistance which are provided in accordance with the invention have strength-improving effects upon all of both arms of the user, from the fingertips to the shoulders. Though the biceps muscles are importantly (but not so obviously) involved in the supinating action, so are some other muscles in the forearms, wrists, hands, and fingers, and all of these benefit from the exercise that they obtain when there is used a device according to the invention, which provides resistance to the supinating action, in place of a device known according to the prior art, where the objective was to afford "greater ease of movement, more flexibility and less strain".

While I have shown and described herein certain embodiments of our invention we intend to cover as well any change or modification therein which may be made without departing from its spirit and scope.

I claim as my invention:

1. Exercise means including an elongated handle means to be grasped by the user, said handle means being located within circular housing means for rotatory motion with respect thereto, a shoe member carried by each of opposite ends of said elongated handle means for rotary motion in said housing means, means operatively associated with the shoe members for varying the degree of resistance to rotatory motion of said handle means with respect to the circular housing means within which it is located and elongated bar means operatively associated with said housing means for bearing weights.

2. Exercise means as defined in claim 1, wherein said handle means extends substantially diametrically with respect to said circular housing means.

3. Exercise means as defined in claim 1, wherein said means operatively associated with the shoe member are such as to permit effectively the locking of said handle means in a desired position relative to said housing means circular.

4. Exercise means as defined in claim 3, wherein said handle means extend substantially diametrically with respect to said circular housing means.

5. Barbell-type exercise means, including handles to be grasped by the user, a circular housing means within which each of said handles is located for rotatory motion with respect thereto, said circular housing means having an interiorly located groove or pathway, shoe means engageable in said groove or pathway and operatively associated with each of said handles for varying the degree of resistance to rotatory motion of each of said handles with respect to the circular housing means, and each of said circular housing means being operatively associated with the other and with an elongated bar means for bearing weights.

6. Barbell-type exercise means as defined in claim 5, wherein each of said handle means extends substantially diametrically with respect to the circular housing means in which it is located.

7. Barbell-type exercise means as defined in claim 5, wherein said means for varying the degree of resistance to rotatory motion of said handle means with respect to said circular housing means are such as to permit effectively the locking of said handle means in a desired position.

8. Barbell-type exercise means as defined in claim 7, wherein each of said handle means extends substantially diametrically with respect to the circular housing means within which it is located.

9. Barbell-type exercise means as defined in claim 5, wherein said groove or pathway is smooth and of uniform cross section, extending throughout the entire interior circumferential extent of said housing, said shoe means comprising a pair of shoe members adapted to ride slidingly in said groove or pathway, said handle member or means having at end thereof protruding portions which are snugly received within recesses in the said shoe members, and said handle means further comprising threaded means for increasing or decreasing as desired the overall length of said handle member and the degree of force exerted thereby on said shoe members.

10. Barbell-type exercise means as defined in claim 5, wherein said groove or pathway is smooth and of uniform cross section, extending throughout the entire interior circumferential extend of said housing, said shoe means having a thickness sufficient to be frictionally engaged by a cap-member means threadedly connected to said circular housing means to form a part of said groove or pathway.

11. Barbell-type exercise means as defined in claim 5, wherein said elongated bar means further includes a plurality of spacer members having different lengths, each of said spacer members having at a first end thereof a male connection member and at a second and opposite end thereof a female connection member, and said circular housing members being provided, one with a male connection member and the other with a female connection member, whereby said circular housing members may be joined directly together or may be assembled with one of said spacer members in a desired spaced relationship.

12. A method of exercising and strengthening the biceps muscles of the human body, particularly with reference to their supination function, which comprises grasping with the hands of the user in a position of palms facing each other a pair of spaced apart handle means, each of said handle means being substantially diametrically located within a circular housing means and mounted for rotatory motion with respect thereto, selecting the the resistance to rotatory motion by each of said handle means with respect to the circular housing means in which the respective handle means can rotate, and then moving the hands of the user to independently rotate said handle means against the selected resistance, by turning the hands of the user to a position with the palms facing the user's chest while causing rotatory motion of said handle means with respect to the circular housing means within which it is located and in so doing overcoming the selected resistance to such rotatory motion.

13. A method of exercising and strengthening the upper-arm muscles of the human body in respect to the functions of supination and pronation comprising, practicing the steps of claim 12 and then returning the hands of the user to the position wherein the palms face each other, while the user continues to grasp said handle means.

* * * * *